US009610579B2

(12) United States Patent
Oppenheimer et al.

(10) Patent No.: US 9,610,579 B2
(45) Date of Patent: Apr. 4, 2017

(54) FLUID DELIVERY DEVICES, SYSTEMS, AND METHODS

(71) Applicant: Daktari Diagnostics, Inc., Cambridge, MA (US)

(72) Inventors: Aaron Oppenheimer, Cambridge, MA (US); Lutz Weber, Zweibruecken (DE); Matthias Kronsbein, Kaiserslautern (DE); Zachary Jarrod Traina, Hingham, MA (US); Philip Charles Walker, Concord, MA (US); Andrew Boyce, Hopkinton, MA (US); Adam Casey, Whitman, MA (US)

(73) Assignee: Daktari Diagnostics, Inc., Cambridge, MA (US)

( * ) Notice: Subject to any disclaimer, the term of this patent is extended or adjusted under 35 U.S.C. 154(b) by 0 days.

(21) Appl. No.: 14/590,247

(22) Filed: Jan. 6, 2015

(65) Prior Publication Data

US 2015/0190802 A1 Jul. 9, 2015

Related U.S. Application Data

(60) Provisional application No. 61/924,511, filed on Jan. 7, 2014.

(51) Int. Cl.
*B01L 3/00* (2006.01)

(52) U.S. Cl.
CPC ..... *B01L 3/50273* (2013.01); *B01L 3/502715* (2013.01); *B01L 3/523* (2013.01); *B01L 2300/044* (2013.01); *B01L 2300/0816* (2013.01); *B01L 2400/0478* (2013.01); *B01L 2400/0481* (2013.01); *B01L 2400/0683* (2013.01); *Y10T 137/0318* (2015.04)

(58) Field of Classification Search
USPC ..... 422/501–505, 509; 436/180
See application file for complete search history.

(56) References Cited

U.S. PATENT DOCUMENTS 3,608,543 A 9/1971 Longini
3,781,671 A 12/1973 Preikschat
(Continued)

FOREIGN PATENT DOCUMENTS

EP 1091718 A1 4/2001
GB 893907 A1 4/1962
(Continued)

OTHER PUBLICATIONS

International Search Report and Written Opinion for PCT/US2015/010322, mailed Apr. 24, 2015, 14 pages.
(Continued)

*Primary Examiner* — Dean Kwak
(74) *Attorney, Agent, or Firm* — Fish & Richardson P.C.

(57) ABSTRACT

This document provides devices, systems, and methods for delivering fluids. In some cases, the devices, systems, and methods include a deformable reservoir being at least partially defined by rigid plastically-deformable web. An actuator can press against said rigid plastically-deformable web to plastically deform said web. In some cases, a controller is adapted to receive a cartridge including a deformable reservoir and control the pressing of an actuator against a rigid plastically-deformable web to deliver fluid from the deformable reservoir.

17 Claims, 5 Drawing Sheets

(56) References Cited

U.S. PATENT DOCUMENTS

| | | | |
|---|---|---|---|
| 4,283,675 | A | 8/1981 | Sparber |
| 4,289,035 | A | 9/1981 | Lee |
| 4,459,856 | A | 7/1984 | Ko |
| 6,204,668 | B1 | 3/2001 | Sequeira |
| 7,482,733 | B2 | 1/2009 | Weber |
| 8,242,792 | B2 | 8/2012 | Drimusz |
| 8,783,488 | B2 | 7/2014 | Weber |
| 8,950,424 | B2 | 2/2015 | Weber et al. |
| 2005/0142571 | A1 | 6/2005 | Parthasarathy |
| 2006/0183216 | A1 | 8/2006 | Handique et al. |
| 2007/0089988 | A1 | 4/2007 | Chung |
| 2008/0217246 | A1* | 9/2008 | Benn ..... G01N 35/00029 210/645 |
| 2009/0042281 | A1 | 2/2009 | Chang et al. |
| 2009/0105557 | A1 | 4/2009 | Najafi |
| 2010/0109687 | A1 | 5/2010 | Drimusz |
| 2011/0207621 | A1 | 8/2011 | Montagu et al. |
| 2011/0212453 | A1 | 9/2011 | Agarwal et al. |
| 2011/0280776 | A1 | 11/2011 | Tanaami et al. |
| 2011/0297866 | A1 | 12/2011 | Weber |
| 2011/0303306 | A1 | 12/2011 | Weber |
| 2012/0082599 | A1 | 4/2012 | Weber |
| 2012/0107811 | A1 | 5/2012 | Kelso et al. |
| 2012/0142026 | A1 | 6/2012 | Miller et al. |
| 2013/0087226 | A1 | 4/2013 | Weber |
| 2013/0263940 | A1 | 10/2013 | Weber |
| 2013/0302787 | A1 | 11/2013 | Agarwal et al. |
| 2013/0327672 | A1 | 12/2013 | Kurowski et al. |
| 2013/0331298 | A1 | 12/2013 | Rea |
| 2014/0000735 | A1 | 1/2014 | Weber et al. |
| 2015/0190805 | A1 | 7/2015 | Etheredge |
| 2016/0123975 | A1 | 5/2016 | Etheredge |

FOREIGN PATENT DOCUMENTS

| | | | |
|---|---|---|---|
| GB | 1487101 | A1 | 9/1977 |
| WO | WO2007106579 | A1 | 9/2007 |
| WO | WO2007106598 | A1 | 9/2007 |
| WO | WO2008147382 | A1 | 12/2008 |
| WO | WO 2009/052805 | | 4/2009 |
| WO | WO 2009/071078 | | 6/2009 |
| WO | WO 2012/019599 | | 6/2012 |
| WO | WO2012137122 | A1 | 10/2012 |
| WO | WO2014066704 | A1 | 5/2014 |
| WO | WO 2014/090225 | | 6/2014 |
| WO | WO2014153651 | A1 | 10/2014 |
| WO | WO 2015/001070 | | 1/2015 |

OTHER PUBLICATIONS

U.S. Appl. No. 14/929,705, filed Nov. 2, 2015, Etheredge.

Bhat et al., "Thermal bonding of polypropylene nonwovens: effect of bonding variables on the structure and properties of the fabrics," J Appl Polym Sci, 92(6):3593-3600, 2004.

Cheng et al., "A microfluidic device for practical label-free CD4(+) T cell counting of HIV-infected subjects," Lab Chip., 7(2):170-178, Epub Nov. 24, 2006 [author manuscript].

Sun et al., "Digital signal processing methods for impedance microfluidic cytometry," Microfluidics and nanofluidics, 6(2):179-187, Feb. 1, 2009.

Toner et al., "Blood-on-a-chip," Annu Rev Biomed Eng., 7:77-103, 2005 [author manuscript].

International Preliminary Report on Patentability for PCT/US2015/010322, mailed Jul. 21, 2016, 10 pages.

United States Office action in U.S. Appl. No. 14/591,696, dated Sep. 2, 2016, 35 pages.

* cited by examiner

FLUID DELIVERY DEVICES, SYSTEMS, AND METHODS

CROSS-REFERENCE TO RELATED APPLICATIONS

This application claims benefit of priority from U.S. Provisional Application Ser. No. 61/924,511, filed on Jan. 7, 2014.

TECHNICAL FIELD

This document relates to devices, systems, and methods involved in delivering fluids. For example, this document provides deformable reservoirs and actuators configured to precisely meter small volumes of reagent, which can be used in microfluidic systems for diagnosing one or more disease conditions.

BACKGROUND

In parts of the world, diseases such as HIV infection (and various stages of the disease), syphilis infection, malaria infection, and anemia are common and debilitating to humans, particularly to pregnant women. For example, nearly 3.5 million pregnant women are HIV-infected, and nearly 700,000 babies contract HIV from their mothers each year. These infant HIV infections can be prevented by identifying and treating mothers having HIV. In addition, nearly 20% of pregnant women in developing countries are infected with syphilis, leading to more than 500,000 infant stillbirths and deaths each year. Nearly 10,000 women and 200,000 infants die each year from malaria during pregnancy, and nearly 45% of pregnant women in developing countries suffer from anemia as a result of, for example, worm infections, parasites, and/or nutritional deficiencies. Anemia can adversely affect a pregnant woman's chance of surviving post-partum hemorrhage and stunt infant development. About 115,000 maternal deaths and 500,000 infant deaths have been associated with anemia in developing countries. Point-of-care medical diagnostic tools, however, can require one or more reagents, which must be stored in a stable environment until they are used, at which point they must be dispensed in precisely controlled volumes and flow rates.

SUMMARY

This document provides devices, systems, and methods for creating precise flow rates of fluids and precise metering of small volumes of fluid. Devices, systems, and methods provided herein can also store fluids in a stable and sterile environment. Assays on small amounts of sample (e.g., blood) can require precise metering of small volumes of reagents. In some cases, devices, systems, and methods provided herein can deliver precise flow rates of one or more reagents used to determine whether a human has a certain disease condition. Devices, systems, and methods provided herein can provide precise volumes of one or more reagents. Devices, systems, and methods provided herein can store reagents in a sterile and stable environment.

In some aspects, a system for controlled fluid delivery in a microfluidic device provided herein can include the use of a cartridge including a deformable reservoir, an actuator, and a controller. In some cases, the actuator can be a separate component, can be part of the cartridge, or can be a part of the controller. The controller can be adapted to receive the cartridge. For example, the controller can be adapted to receive the cartridge and run one or more diagnostic tests (e.g., to discover a disease condition). The deformable reservoir can include at least one rigid plastically-deformable web. The deformable reservoir can include a fluid (e.g., a reagent used in a diagnostic analysis). In some cases, the cartridge can include at least one microfluidic channel. The actuator can have a pressing surface adapted to press against the rigid plastically-deformable web to plastically deform the rigid plastically-deformable web and pressurize the deformable reservoir such that a breakable seal opens and fluid is delivered out of the deformable reservoir. The controller can control the pressing of the actuator against the deformable reservoir to control the delivery of fluid out of the deformable reservoir (e.g., to a microfluidic channel).

The deformable reservoir can be constructed in any suitable manner using any suitable material or combination of materials. In some cases, the rigid plastically-deformable web and a second web are attached along a peripheral seal to define a cavity there between. A breakable seal section can be positioned about the periphery of the cavity to allow fluid to be released from the deformable reservoir when a load applied to the rigid plastically-deformable web exceeds a first predetermined force. For example, the first predetermined force can be between 2N and 35N. The peripheral seal, however, is stable at pressures generated in the cavity when the first predetermined force is applied with the actuator such that the sealed webs do not delaminate, which could alter the flow characteristics of the fluid leaving the deformable reservoir through the breakable seal. The rigid plastically-deformable web and the second web are adapted to not expand (e.g., balloon) when pressure within the cavity exceeds the first predetermined pressure, which can also alter the flow characteristics of the fluid leaving the deformable reservoir through the breakable seal. In some cases, the rigid plastically-deformable web and/or the second web includes aluminum (e.g., cold-formed aluminum coated with a heat-seal lacquer and/or protective outer coating). In some cases, a second web can be positioned and/or attached to a rigid backbone, thus in some cases, the second web can be less rigid than the rigid plastically-deformable web.

The deformable reservoir can have any suitable shape. In some cases, the deformable reservoir can have a convex outer surface. For example, in some cases, the deformable reservoir can have an "igloo" shape. A convex outer surface on a deformable reservoir can facilitate the plastic deformation of a rigid plastically-deformable web. For example, a semi-spherical rigid plastically-deformable web can be pressed by an actuator such that the pressed portion of the semi-spherical rigid plastically-deformable web inverts inward such that the outer surface of the deformable reservoir includes a concave portion. The inversion of the rigid plastically-deformable web can limit an amount of elastic recoil when the actuator is released from the deformable reservoir.

The pressing surface of the actuator can match the outer surface of the deformable reservoir. Having matching surfaces on the actuator and the rigid plastically-deformable web can ensure a controlled delivery of fluid from the deformable reservoir. In some cases, the matching surfaces can ensure that the rigid plastically-deformable web does not wrinkle upon itself as pressed. In some cases, wrinkling of the rigid plastically-deformable web can occur. In some cases, the matching surfaces are congruent. In some cases, the matching surfaces are curved. In some cases, both matching surfaces are convex. In some cases, the matching surfaces are semispherical. In some cases, the matching surfaces are "igloo" shaped. In some cases, congruent surfaces (e.g., flat surfaces) can be pressed against each other such that sides surrounding the upper surface of the deformable reservoir fold. In some cases, the matching surfaces can be positioned prior to pressing such that they curve away from each other, but press against each other such that the upper surface of the deformable reservoir inverts to form a smooth interface against the pressing surface of the actuator. In some cases, the matching surfaces are mirror images of each other. In some cases, the matching surfaces each have a radius of curvature that is within 20% of each other, within 15% of each other, within 10% of each other, within 5% of each other, within 3% of each other, within 1% of each other, or within 0.5% of each other.

In some cases, a central projecting portion of an actuator pressing surface presses against a central projecting portion of an upper surface of the deformable reservoir to invert said the central projecting portion of said deformable reservoir when said cartridge is received in said controller and said actuator is pressed against said deformable reservoir. In some cases, a central axis of the pressing surface can be aligned with a central axis of said deformable reservoir when said cartridge is received in the controller and the actuator is pressed against the deformable reservoir.

The actuator can be pressed against the deformable reservoir such that it produces a controlled flow of fluid out of the deformable reservoir. In some cases, the actuator can be pressed against the deformable reservoir such that it produces a constant flow of fluid out of the deformable reservoir. In some cases, the controller can include a stepper-motor capable of moving the actuator with micron-level advancement and an encoder to provide feedback regarding the position of said actuator. In some cases, the controller is adapted to deliver said fluid at a rate of between 1 μl/min and 500 μl/min, between 2 μl/min and 250 μl/min, between 5 μl/min and 100 μl/min, between 7 μl/min and 75 μl/min, between 10 μl/min and 50 μl/min, or between 20 μl/min and 40 μl/min. In some cases, the controller is adapted to limit the variance of the flow rate once the flow rate is achieved. In some cases, the variance of the flow rate from a mean flow rate is within +/−20%, +/−15%, +/−10%, or +/−5%. In some cases, a controller can include a non-linear software control for moving the actuator to compensate for a shape of the deformable reservoir and a shape of the actuator. For example, a dome-shaped deformable reservoir and a corresponding dome-shaped actuator will require a non-linear advancement of the actuator to achieve a constant flow rate.

The deformable reservoir can be made of any suitable plastically-deformable material. In some cases, the deformable reservoir can include a polymer, a metal, or a combination thereof. The deformable reservoir can have any suitable structure. The deformable reservoir can be formed between two webs hermetically sealed around periphery of the deformable reservoir. For example, the deformable reservoir can include a top layer of cold-formable aluminum, which can include a heat-seal lacquer on a bottom side and a protecting polymer coating on a top side. The selection of the particular material(s) can impact the amount of pressure required to deform the deformable reservoir. In some cases, the deformable reservoir is domed shaped.

The deformable reservoir can include a breakable seal between the deformable reservoir and a microfluidic channel. In some cases, the breakable seal can be adapted to be opened by pressurizing an interior of the deformable reservoir by pressing the deformable seal with the actuator. In some cases, the deformable reservoir can be bonded to a backbone. A backbone can provide a rigid support for a deformable reservoir provided herein. In some cases, a backbone provided herein can define one or more microfluidic channels. The backbone can define a relief area under said breakable seal, which can help ensure that the breakable seal opens when an interior of the deformable reservoir is pressurized. In some cases, the cartridge can include at least one impedance-measurement circuit in said at least one microfluidic channel. A controller can use the at least one impedance-measurement circuit to determine a location of said fluid in said microfluidic channel, which can provide feedback to further control the flow of fluid out of the deformable reservoir. In some cases, a cartridge can include two or more deformable reservoirs, and a controller can use one or more actuators to press the two or more deformable reservoirs to control the flow of fluid from the two or more deformable reservoirs.

The actuator can be a separate component, part of a cartridge carrying the deformable reservoir, or part of a controller. In some cases, the actuator is held by said cartridge and adapted to be actuated by a presser when said cartridge and actuator are received in said controller. For example, a ring can surround the deformable reservoir and the actuator to align the deformable reservoir and the actuator. In some cases, a controller can include the actuator. In some cases, an actuator can be a separate component that can be inserted at the same time that the cartridge is inserted into the controller.

A method for delivering a fluid provided herein can include aligning a deformable reservoir provided herein and an actuator and pressing the actuator against an upper surface of the deformable reservoir to deform the deformable reservoir and force fluid out of the deformable reservoir. In some cases, the deformable reservoir is part of a cartridge and the step of aligning the deformable reservoir with the actuator includes inserting the cartridge into a controller that includes an actuator. A pressing surface of the actuator and the upper surface of the deformable reservoir can match. In some cases, both the upper surface and the pressing surface are curved away from each other such that a central projecting portion of the pressing surface presses against a central projecting portion of the deformable reservoir to invert the central projecting portion of the deformable reservoir. In some cases, both the upper surface and the pressing surface are flat such that the pressing of the actuator against the upper surface keeps the upper surface wrinkle free and sides surfaces of said deformable reservoir fold.

A method for running a diagnostic analysis provided herein can include delivering a blood sample to a cartridge, inserting the cartridge into a controller, and activating the controller to run a diagnostic analysis, where the diagnostic analysis includes a step of delivering a reagent fluid from a deformable reservoir on the cartridge by pressing an upper surface of the deformable reservoir with a matching pressing surface of an actuator. Pressing the actuator against the deformable reservoir can break a breakable seal along a periphery of the deformable reservoir to allow reagent to enter at least one microfluidic channel and mix with the blood sample.

In some cases, a method of delivering fluids provided herein includes delivering multiple fluids from multiple deformable reservoirs. In some cases, a diagnostic device provided herein can require a precise metering of one or more reagents. For example, an assay may require a precise metering of one or more staining reagents and/or a washing reagent. In some cases, a single actuator can be used to deliver fluids from different deformable reservoirs in sequence. In some cases, multiple actuators can be used. In some cases, two or more deformable reservoirs can be connected to one another through a breakable seal for mixing of two liquids, a liquid and a solid (such as a lyophilized power), or other components. A second breakable seal may then be breached to provide flow of the combined materials.

The devices, systems, and methods provided herein can provide a reliable and inexpensive method to deliver small amounts of fluid precisely. For example, in some cases, diagnostic assays can require the introduction of reagent at constant and specific rates. The devices, systems, and methods provided herein can also keep reagent fluid pure and stable for each cartridge, which can be difficult if the reagent is accessed from an external deformable reservoir that is used for multiple cartridges. The devices, systems, and methods provided herein can be more reliable than metering methods that rely upon the precision of pumping mechanisms used to meter fluids from an external deformable reservoir.

The details of one or more embodiments are set forth in the accompanying drawings and the description below. Other features and advantages will be apparent from the description and drawings, and from the claims.

DESCRIPTION OF DRAWINGS

Like reference symbols in the various drawings indicate like elements.

DETAILED DESCRIPTION

Figure 1:
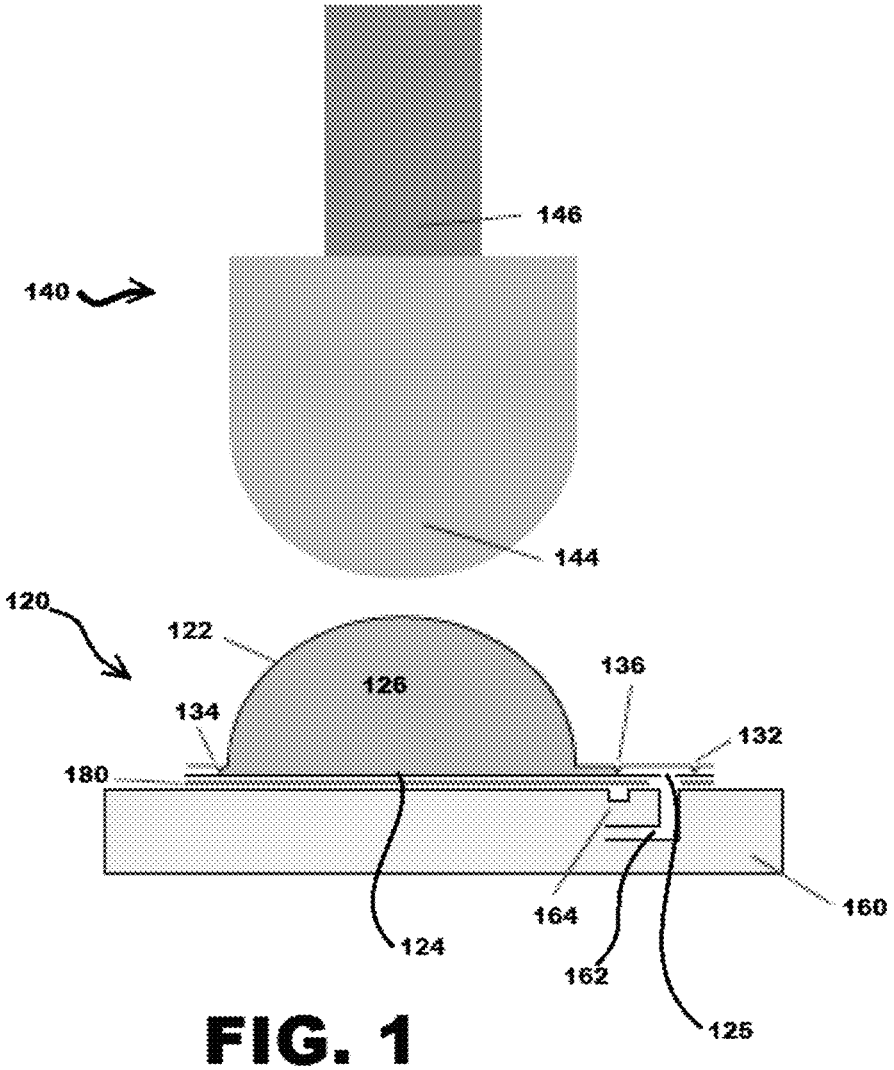
FIG. 1 depicts an example of a first embodiment of a fluid delivery system provided herein.

This document provides methods and devices related to metering precise amounts of fluid. In some cases, the devices, systems, and methods provided herein relate to diagnosing one or more disease conditions (e.g., HIV infections, syphilis infections, malaria infections, anemia, gestational diabetes, and/or pre-eclampsia). For example, a biological sample (e.g., blood) can be collected from a mammal (e.g., pregnant woman) and analyzed using a kit including a cartridge including one or more deformable reservoirs provided herein, each deformable reservoir including a reagent, such that the reagent can be mixed with the biological sample using a controller that receives the cartridge to determine whether or not the mammal has any of a group of different disease conditions. In the case of a device that diagnoses multiple disease conditions, the analysis for each disease condition can be performed in parallel, for example using different reagents from different deformable reservoirs, such that the results for each condition are provided at essentially the same time. In some cases, the devices, systems, and methods provided herein can be used outside a clinical laboratory setting. For example, the devices, systems, and methods provided herein can be used in rural settings outside of a hospital or clinic. Any appropriate mammal can be tested using the methods and materials provided herein. For example, dogs, cats, horses, cows, pigs, monkeys, and humans can be tested using a diagnostic device or kit provided herein.

The devices, systems, and methods provided herein can provide precise metering of small volumes of blood and/or reagents for tests that determine whether or not the mammal has one or more disease conditions. In some cases, devices, systems, and methods provided herein can repeatedly deliver a predetermined and constant flow and/or volume of fluid with a deviation of not more than 10% (e.g., not more than 5%, not more than 3%, not more than 2%, not more than 1%, or not more than 0.5% deviation). The deviation of a device or method provided herein can be assessed by metering ten consecutive volumes of fluid including a reporter molecule (e.g., a fluorescent additive or radiolabel such as tritium), using a signal from the reporter molecule to determine an average volume of each metered fluid (e.g., using a plate-reader), and determining the maximum deviation from that average volume and dividing that maximum deviation by the average volume to determine the deviation. In some cases, an average volume of metered fluid can be determined using Karl Fisher analysis. In some cases, devices, systems, and methods provided herein can be arranged to meter a predetermined volume of fluid of 500 μL or less (e.g., 250 μL or less, 100 μL or less, 75 μL or less, 50 μL or less, 25 μL or less, 10 μL or less, or 5 μL or less). In some cases, devices, systems, and methods provided herein can be arranged to meter a predetermined flow of fluid of between 1 μL/min and 500 μL/min (e.g., between 2 μL/min and 250 μL/min, between 5 μL/min and 100 μL/min, between 7 μL/min and 75 μL/min, between 10 μL/min and 50 μL/min, or between 20 μL/min and 40 μL/min). Flow rates can be measured using a precision flow meter. For example, precision flow meters sold by Senserion can be used to measure low flow rates (e.g., 10 ul/min) and high flow rates (e.g., 1000 ul/min). A flow sensor can be attached to the exit via of the deformable reservoir or at various locations along the fluidic path to measure the flow. For example, for the data shown in FIG. 5, a flow sensor was attached to the exit via of the cuvette of a cartridge.

Deformable reservoirs provided herein can also be used in non-diagnostic devices. In some cases, deformable reservoirs provided herein can be used for the delivery of fluids such as medicines, colorants, flavorants, and/or combinations thereof. For example, a deformable reservoir provided herein can be filled with a medication, and a controller could be used to infuse a precise amount of that medication to a mammal based on a predetermined schedule. In some cases, deformable reservoirs provided herein can include flavorants and/or colorants and be used to with a controller to create custom drinks or foods. Other applications for the precise delivery of one or more fluids are also contemplated. In some cases, two or more deformable reservoirs can be connected to one another through a breakable seal for mixing of two liquids, a liquid and a solid (such as a lyophilized power), or other components. A second breakable seal may then be breached to provide flow of the combined materials.

In some cases, the devices, systems, and methods provided herein can use a deformable reservoir having rigid plastically-deformable upper web adapted to be deformed by an actuator. In some cases, the actuator is adapted to invert a curved surface of the rigid plastically-deformable upper web. In some cases, the actuator has a matching surface adapted to invert the rigid plastically-deformable upper web while minimizing wrinkles in the web. A wrinkling deformable reservoir surface can occur in unexpected patterns and result in an uneven flow of fluids out of the deformable reservoir. In some cases, the deformable reservoir can be used for reagent storage on a cartridge use for point-of-use medical diagnostics. In some cases, the deformable reservoir is adapted to store several hundred microliters of reagent for an extended period of time (e.g., at least 10 days, at least 30 days, at least 3 months, at least 6 months, at least 1 year, or at least 2 years).

In some cases, matching surfaces on the actuator and the deformable reservoir are congruent. In some cases, the matching surfaces are curved. In some cases, both matching surfaces are convex. In some cases, the matching surfaces are semispherical. In some cases, the matching surfaces are "igloo" shaped. In some cases, the matching surfaces can be positioned prior to pressing such that they curve away from each other, but press against each other such that the upper surface of the deformable reservoir inverts to form a smooth interface against the pressing surface of the actuator. In some cases, matching surfaces are mirror images of each other. In some cases, the matching surfaces each have a radius of curvature that is within 20% of each other, within 15% of each other, within 10% of each other, within 5% of each other, within 3% of each other, within 1% of each other, or within 0.5% of each other.

In some cases, a central projecting portion of an actuator pressing surface presses against a central projecting portion of an upper surface of the deformable reservoir to invert said the central projecting portion of said deformable reservoir when said cartridge is received in said controller and said actuator is pressed against said deformable reservoir. In some cases, a central axis of the pressing surface can be aligned with a central axis of said deformable reservoir when a cartridge is received in the controller and the actuator is pressed against the deformable reservoir.

The actuator can be pressed against the deformable reservoir such that it produces a controlled flow of fluid out of the deformable reservoir. In some cases, the actuator can be pressed against the deformable reservoir such that it produces a constant flow of fluid out of the deformable reservoir. In some cases, the controller can include a stepper-motor capable of moving the actuator with micron-level advancement and an encoder to provide feedback regarding the position of said actuator. In some cases, the controller is adapted to deliver said fluid at a rate of between 1 μl/min and 500 μl/min, between 2 μl/min and 250 μl/min, between 5 μl/min and 100 μl/min, between 7 μl/min and 75 μl/min, between 10 μl/min and 50 μl/min, or between 20 μl/min and 40 μl/min. In some cases, a controller can include a non-linear software control for moving the actuator to compensate for a shape of the deformable reservoir and a shape of the actuator. For example, a dome-shaped deformable reservoir and a corresponding dome-shaped actuator will require a non-linear advancement of the actuator to achieve a constant flow rate.

The rigid plastically-deformable web can be plastically deformed with less than 20% recoil, less than 15% recoil, less than 10% recoil, less than 5% recoil, less than 2% recoil, less than 1% recoil, or less than 0.5% recoil. In some cases, the rigid plastically-deformable web can include aluminum. Webs including aluminum can be bonded together using any suitable bonding agent. In some cases, rigid plastically-deformable webs used in a deformable reservoir provided herein can include one or more metal layers and one or more polymer layers. For example, a polymer coating on an aluminum layer can be used to help seal the adjacent webs together.

Figure 2:
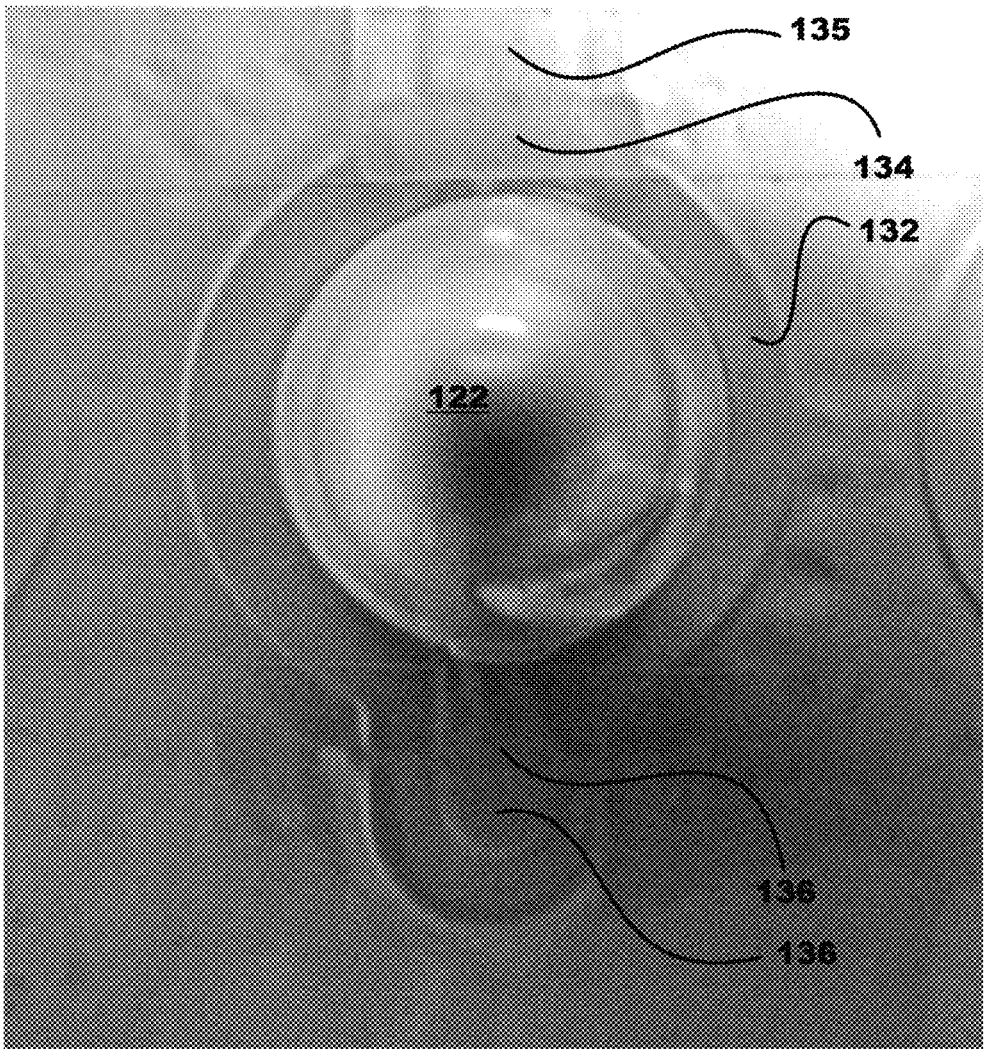
FIG. 2 shows an arrangement of seals placed along a deformable reservoir provided herein.

FIG. 1 depicts exemplary embodiments of a fluid delivery system provided herein. As shown, a cartridge 110 includes a backbone 160 and a deformable reservoir 120 defined between an upper web 122 and a lower web 124. Deformable reservoir 120 can include a fluid 126. Upper web 122 has a dome shape and is bonded to lower web 124 with a peripheral seal 132, a fill port seal 134, and a breakable seal 136. FIG. 2 depicts the positions of these seals in further detail. Upper web 122 can be cold-formed into the dome shape or any other suitable shape. Peripheral seal 132 can be made prior to filling deformable reservoir 120 with fluid 126. A fill gap in the peripheral seal can provide a path for filling deformable reservoir 120 with fluid 126. After filling deformable reservoir 120 with fluid 126, a fill seal 134 can be made to seal the fill gap. Peripheral seal 132 and fill seal 134 can form a resilient seal between upper web 122 and lower web 124. In some cases, peripheral seal 132 and fill seal 134 are melt bonded.

Breakable seal 136 can be positioned to isolate an opening 125 in lower web 124. Breakable seal 136 is adapted to break when a load applied to the rigid plastically-deformable web 122 exceeds a certain threshold, but prior to the breakage of other parts of the deformable reservoir 120 or other seals of the deformable reservoir 120. In some cases, backbone 160 can include a cutout 164 under breakable seal 136 to support seal breakage. In some cases, a threshold load applied to the rigid plastically deformable web 122 to break breakable seal 136 is between 2N and 50N, between 15N and 30N, or between 10N and 20N. Peripheral seal 132 and fill seal 134 can more resilient seals than breakable seal 136. The processing conditions used when making each seal can determine the strength of each seal.

A backbone 160 can support deformable reservoir 120. Backbone 180 can be bonded to the deformable reservoir 120 by any suitable method. For example, as shown in FIG. 1, backbone 160 can be attached to the deformable reservoir 120 by a bonding layer 180. Backbone 160 can include a microfluidic channel 162 and/or other channels adapted to receive fluid 126 from deformable reservoir 120. For example, backbone 160 can include chambers adapted to mix a biological sample (e.g., blood) with one or more reagents for the detection of one or more disease characteristics.

Figure 5:
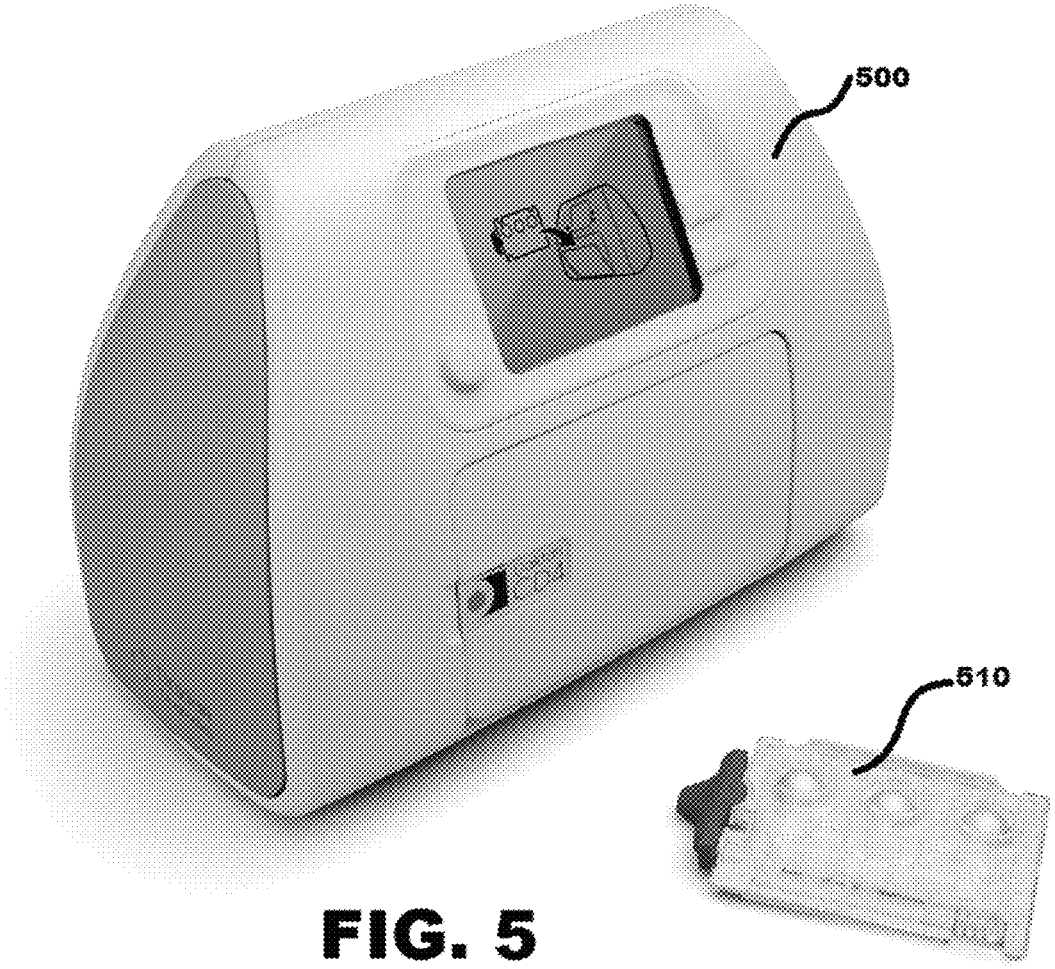
FIG. 5 depicts an example of a controller and a cartridge.

Actuator 140 can have any suitable shape or size. Actuator 140, in some cases, has a pressing surface that matches an outer shape of upper web 122. Movement of actuator 140 can be controlled with a motor 146. Actuator 140 can be pressed against deformable reservoir 120 such that it produces a controlled flow of fluid past breakable seal 136. In some cases, motor 146 can include a stepper-motor capable of moving pressing device 140 with micron-level advancement. In some cases, motor 146 can include an encoder to provide feedback regarding the position of actuator 140. In some cases, a controller is used to move actuator 140. For example, FIG. 5 depicts an exemplary controller 500 adapted to receive a cartridge 510 including one or more deformable reservoirs provided herein. In some cases, the controller is adapted to deliver said fluid at a rate of between 1 μl/min and 500 μl/min, between 2 μl/min and 250 μl/min, between 5 μl/min and 100 μl/min, between 7 μl/min and 75 μl/min, between 10 μl/min and 50 μl/min, or between 20 μl/min and 40 μl/min. Controller 500 can include a non-linear software control for moving the actuator to compensate for a shape of a deformable reservoir and a shape of the actuator. For example, a dome-shaped deformable reservoir 120, such as shown in FIG. 1, and a corresponding dome-shaped actuator 140, such as shown in FIG. 1, will require a non-linear advancement of the actuator to achieve a constant flow rate.

FIG. 2 shows a pattern of seals used to seal upper web 122 to lower web 124. As shown, a peripheral seal 132 extends around the dome-shaped cavity 126, defines an outflow port 133, and leaves a fill gap to allow for fluid to be delivered through fill port 135. The outflow port 137 includes an opening 125 in a lower web 124. A breakable seal 136 isolates the outflow port 137 and opening 125 from the remainder of the cavity. After a fluid is provided to the cavity though fill port 135, a fill seal 134 is made to enclose the deformable reservoir.

Figure 3:
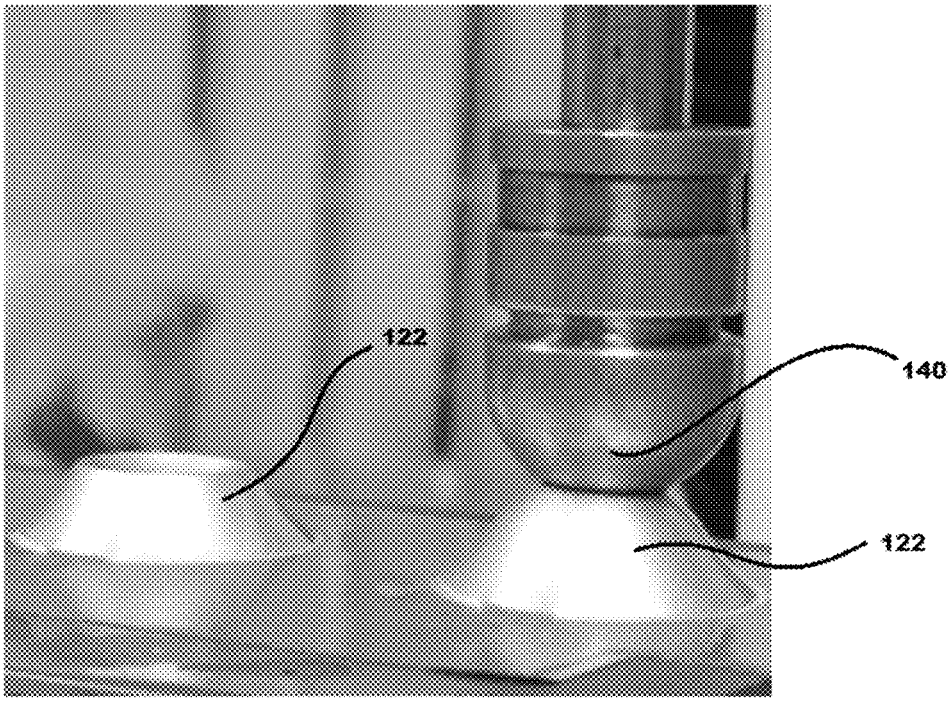
FIG. 3 depicts an example of an actuator pressing against a deformable reservoir provided herein.

FIG. 3 depicts an example deformable reservoir 120 being pressed by an actuator 140. As shown, upper web 122 plastically deforms, which pressurizes the deformable reservoir to a pressure at which the breakable seal breaks to allow a flow of fluid 126 past breakable seal 136.

The deformable reservoir can include a breakable seal between the deformable reservoir and a microfluidic channel. In some cases, the breakable seal can be adapted to be opened by pressurizing an interior of the deformable reservoir by pressing the deformable seal with the actuator. In some cases, the deformable reservoir can be bonded to a backbone. The backbone can define one or more microfluidic channels. The backbone can define a relief area under said breakable seal, which can help ensure that the breakable seal opens when an interior of the deformable reservoir is pressurized. In some cases, the cartridge can include at least one impedance-measurement circuit in said at least one microfluidic channel. A controller can use the at least one impedance-measurement circuit to determine a location of said fluid in said microfluidic channel, which can provide feedback to further control the flow of fluid out of the deformable reservoir. In some cases, a cartridge can include two or more deformable reservoirs and a controller can use one or more actuators to press the two or more deformable reservoirs to control the flow of fluid from the two or more deformable reservoirs.

The actuator can be a separate component, part of a cartridge carrying the deformable reservoir, or part of a controller. In some cases, the actuator is held by said cartridge and adapted to be actuated by a presser when said cartridge and actuator are received in said controller. For example, a ring can surround the deformable reservoir and the actuator to align the deformable reservoir and the actuator. In some cases, a controller can include the actuator. In some cases, an actuator can be a separate component that can be inserted at the same time that the cartridge is inserted into the controller.

A method for delivering a fluid provided herein can include aligning deformable reservoir and an actuator and pressing the actuator against an upper surface of the deformable reservoir to deform the deformable reservoir and force fluid out of the deformable reservoir. In some cases, the deformable reservoir is part of a cartridge and the step of aligning the deformable reservoir with the actuator includes inserting the cartridge into a controller that includes an actuator. A pressing surface of the actuator and the upper surface of the deformable reservoir can match. In some cases, both the upper surface and the pressing surface are curved away from each other such that a central projecting portion of the pressing surface presses against a central projecting portion of the deformable reservoir to invert the central projecting portion of the deformable reservoir. In some cases, both the upper surface and the pressing surface are flat such that the pressing of the actuator against the upper surface keeps the upper surface wrinkle free and sides surfaces of said deformable reservoir fold.

A method for running a diagnostic analysis provided herein can include delivering a blood sample to a cartridge, inserting the cartridge into a controller, and activating the controller to run a diagnostic analysis, where the diagnostic analysis includes a step of delivering a reagent fluid from a deformable reservoir on the cartridge by pressing an upper surface of the deformable reservoir with a matching pressing surface of an actuator. Pressing the actuator against the deformable reservoir can break a breakable seal along a periphery of the deformable reservoir to allow reagent to enter at least one microfluidic channel and mix with the blood sample.

Figure 4:
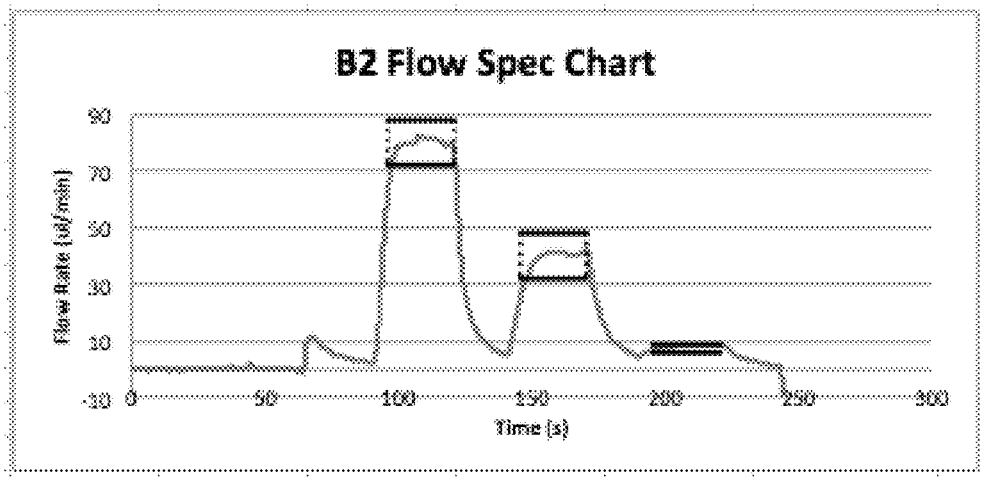
FIG. 4 depicts an exemplary flow rates produced by a fluid delivery system provided herein.

FIG. 4 shows flow rates achieved use deformable reservoirs provided herein. As shown, an initial pressurizing of the deformable reservoir creates an initial flow upon the breaking of the breakable seal. Subsequent movement of an actuator to further plastically deform a rigid plastically-deformable upper web can be controlled to produce steady flows of fluids from the deformable reservoir.

A number of embodiments of the invention have been described. Nevertheless, it will be understood that various modifications may be made without departing from the spirit and scope of the invention. Accordingly, other embodiments are within the scope of the following claims.

What is claimed is:

1. A system for controlled fluid delivery in a microfluidic device comprising:

(a) a cartridge comprising at least one deformable reservoir and at least one microfluidic channel, said deformable reservoir containing a fluid, said deformable reservoir being at least partially defined by deformable web;

(b) an actuator having a pressing surface adapted to press against said deformable web to deform said deformable web; and (c) a controller adapted to receive said cartridge and to control the actuator's pressing of said pressing surface against said deformable web to deliver fluid from the deformable reservoir, wherein an outer surface of said deformable web and said pressing surface comprise dome-shaped minor images of each other, and wherein a central projecting portion of said pressing surface presses against a central projecting portion of said deformable web to invert said central projecting portion of said deformable web when said cartridge is received in said controller and said actuator is pressed against said deformable reservoir, wherein a periphery of said deformable reservoir is defined by seals formed by bonds between said deformable web and a second web material, wherein the seals comprise a resilient seal and a breakable seal, wherein the resilient seal is a stronger seal than the breakable seal, and wherein the breakable seal is adapted to break from pressure created within the deformable reservoir when the actuator is pressed against the deformable reservoir, and wherein said deformable web has a maximum recoil of less than 5% when the deformable web is released after being deformed by said actuator.

2. The system of claim 1, wherein the controller is adapted to control advancement of the actuator against the deformable reservoir in a non-linear manner.

3. The system of claim 1, wherein said outer surface and said pressing surface have radius of curvatures within 10% or less of each other.

4. The system of claim 1, wherein a central axis of said pressing surface is aligned with a central axis of said outer surface when said cartridge is received in said controller and said actuator is pressed against said deformable reservoir.

5. The system of claim 1, wherein said deformable web does not wrinkle when deformed by said actuator.

6. The system of claim 1, wherein the controller is adapted to move the actuator such that said system produces a constant flow into said at least one microfluidic channel.

7. The system of claim 6, wherein the controller is adapted to deliver said fluid at a rate of between 7 μl/min and 75 μl/min.

8. The system of claim 1, wherein said controller comprises a stepper-motor capable of moving the actuator with micron-level advancement and an encoder to provide feedback to said controller regarding positioning of said actuator.

9. The system of claim 1, wherein said deformable reservoir is bonded to a backbone, said backbone defining a relief area under said breakable seal.

10. The system of claim 1, wherein the breakable seal is adapted to open when a load on said deformable reservoir exceeds 2N, and wherein the resilient seal can withstand loads of at least 35N without breaking.

11. The system of claim 1, wherein said deformable web comprises a metal.

12. The system of claim 11, wherein said metal comprises aluminum.

13. The system of claim 1, wherein said deformable web comprises a polymer.

14. The system of claim 1, wherein said actuator is part of said controller.

15. The system of claim 1, wherein said cartridge comprises two or more deformable reservoirs each containing a differing reagent.

16. The system of claim 1, wherein said cartridge comprises at least one impedance-measurement circuit in said at least one microfluidic channel, said controller being adapted to use said at least one impedance-measurement circuit to determine a location of said fluid in said microfluidic channel.

17. The system of claim 1, wherein said seals further comprises a fill port seal that seals a path for filling the deformable reservoir with the fluid.

* * * * *